US006592665B2

(12) United States Patent
Arvérus et al.

(10) Patent No.: US 6,592,665 B2
(45) Date of Patent: Jul. 15, 2003

(54) METHOD AND APPARATUS FOR POWDER COATING

(75) Inventors: Håkan Arvérus, Västra Frölunda (SE); Lars Karlsson, Göteborg (SE); Jaan Kärem, Vimmerby (SE); Maria Strid, Västervik (SE)

(73) Assignee: Triline AB (SE)

( * ) Notice: Subject to any disclaimer, the term of this patent is extended or adjusted under 35 U.S.C. 154(b) by 284 days.

(21) Appl. No.: 09/809,940

(22) Filed: Mar. 16, 2001

(65) Prior Publication Data

US 2001/0018893 A1 Sep. 6, 2001

Related U.S. Application Data

(60) Division of application No. 09/543,999, filed on Apr. 6, 2000, which is a continuation-in-part of application No. 09/011,410, filed on Apr. 8, 1998, now abandoned.

(30) Foreign Application Priority Data

Aug. 10, 1995 (SE) ..... 9502796
Aug. 9, 1996 (WO) ..... PCT/SE96/01004

(51) Int. Cl.[7] ..... B05C 19/00

(52) U.S. Cl. ..... 118/66; 118/308; 118/309; 118/643

(58) Field of Search ..... 118/308, 309, 118/66, 621, 627, 629, 630, 634, 641, 642, 643, 324, 62, 63, 64; 454/50; 239/708; 427/474

(56) References Cited

U.S. PATENT DOCUMENTS

| | | | | |
|---|---|---|---|---|
| 3,617,327 A | | 11/1971 | Daniel | 117/18 |
| 3,974,303 A | | 8/1976 | Iwase et al. | 427/27 |
| 4,009,301 A | | 2/1977 | Heckman et al. | 427/195 |
| 4,122,225 A | * | 10/1978 | Holmstrom et al. | 428/172 |
| 5,395,656 A | | 3/1995 | Liang | 427/393 |
| 5,731,043 A | | 3/1998 | Horinka et al. | 427/475 |
| 5,824,373 A | | 10/1998 | Biller et al. | 427/474 |
| 6,296,939 B1 | * | 10/2001 | Kunze et al. | 428/413 |

FOREIGN PATENT DOCUMENTS

| | | |
|---|---|---|
| DE | 32 11 282 A1 | 9/1983 |
| EP | 0 270 548 B1 | 6/1988 |
| EP | 0 933 140 A1 | 4/1999 |
| WO | 94/22596 A1 | 10/1994 |
| WO | 97/05964 | 2/1997 |

OTHER PUBLICATIONS

Infraredology Today, vol. 5, No. 36, Feb. 2000.
Industrial Finishing Coatings Manufacturing & Application Brochure for Thermal Innovations Corporation.
TRIAB Brochure.
UV Powder Coatings Brochure For Du Pont.
UV Peedoven Sheet on Powder Coating on MDF.
UV Speedoven Sheet on Powder Coating on Heat Sensitive Materials.
Thermal Innovations Corporation Brochure on Gas Infrared Curing Systems.
Thermal Innovations Corporation Brochure on Innovative Solutions for Automotive Finishes.

* cited by examiner

*Primary Examiner*—Richard Crispino
*Assistant Examiner*—Yewebdar T Tadesse
(74) *Attorney, Agent, or Firm*—Lerner, David, Littenberg, Krumholz & Mentlik, LLP

(57) ABSTRACT

Plant for powder coating the surfaces of objects with polymeric powder having a melting and softening temperature below 100° C. The polymeric powder includes a polymer curable under the influence of electromagnetic radiation. Objects to be coated are prepared to retain powder charged with static electricity. The objects are then sprayed with powder charged with static electricity and thereafter heated to a surface temperature of about 100° C. thereby melting the powder retained on the surface by exposure to infrared radiation and heated air. The objects are radiated by electromagnetic radiation for curing of the powder over the surface of the objects.

29 Claims, 3 Drawing Sheets

METHOD AND APPARATUS FOR POWDER COATING

CROSS REFERENCE TO RELATED APPLICATIONS

This application is a division of patent application Ser. No. 09/543,999 filed on Apr. 6, 2000 which was a Continuation-In-Part Application of patent application Ser. No. 09/011,410, filed on Apr. 8, 1998 and which was described and claimed in International Application No. PCT/SE96/01004 filed Aug. 9, 1996, the disclosures of which are incorporated by reference.

BACKGROUND OF THE INVENTION

The present invention relates to a method for powder coating and a plant for carrying out the method.

Powder coating is a well known method for coating of objects in which one starts with a powder coating material which is electrically charged and sprayed against the surfaces of an object, and which material is finally adhered and converted to a solid state by heating to its melting temperature. Since the powder consists of a plastic which is cured by heating, it must be heated to a comparatively high temperature, about 200° C.

This coating method may be performed on objects having good heat resistance and a conductive surface. However, where the surface of an object is non-conductive, implying that the object cannot be grounded or supplied with a charge of an opposite polarity to the charge of the powder, difficulties arise with getting the powder to adhere to the surface of the object during the time between spraying and heating the powder to the melting temperature.

The difficulty of obtaining a polarity difference between the powder and the object, when non-conductive surfaces are involved, has in certain processes been addressed by either varnishing the object with a conductive varnish, or subjecting it to water so as to form a conductive moisture layer on the surface. These methods are, however, of limited use because of disadvantages including the additional operation and material required by varnishing, and inferior adhesion as compared to powder coating on a clean surface. Additionally, when utilizing such methods, discoloration may occur with clear varnishes.

The addition of water may impair the adhesion of the powder coating and can damage the object by confining the added water beneath the coating.

A further method of getting the powder to adhere to the surface of a non-conductive object is disclosed in Albers, German Patent No. 3,211,282. Albers teaches heating glass objects having good heat resistance to a temperature of 400–900° C. This causes the powder granules which impact the object to melt and stick to the surface, making it possible to bring the conversion to a homogenous, solid state to an end. Objects that are heat sensitive may deform when exposed to high temperatures and cannot be treated at the high temperature required by this method. Thus, the method of Albers cannot be applied to heat sensitive objects such as wood or plastic.

An object of the present invention is thus to provide an apparatus and method for polymeric powder coating of heat sensitive objects.

SUMMARY OF THE INVENTION

In accordance with the present invention, these and other objects have now been realized by the invention of an apparatus and method for applying polymeric powder to heat-sensitive objects. The temperatures may be limited to approximately 100° C. and below. When objects having a non-conductive surface are to be coated, the method may be carried out without varnishing with a conductive varnish or addition of moisture. The method of the present invention is therefore suitable for coating objects made of wood or wood based materials as fibre board, and objects made of a plastic, which may be chosen for reasons of tenacity or cost from a type providing the finished object with a surface having a different look than the one possible with the construction plastic itself. When wooden objects are concerned the coating may be a clear varnish, which allows the structure of the wood to stand out.

According to the invention the method comprises the following main steps:

First, preparing a powder for the coating, the powder having a low melting point of approximately 60–100° C. and consisting of a polymer that may be cured by electromagnetic radiation, and especially radiation by ultraviolet light, at a temperature in the region mentioned above or lower.

Second, preparing the object so that the powder may be retained on its surface until a permanent adherence has been achieved by melting and curing the powder. This may be achieved in one or more of the following ways, depending upon the material and the design of the object:

Pre-heating the object to the melting temperature of the powder, making the powder granules stick to the surface during melting. This may be carried out whether or not the object has a conductive surface and with the herein disclosed powder composition at a low temperature.

Retention of the powder by means of electrostatic forces, thus giving the powder an electric potential and the object a potential of the opposite polarity. This may be achieved when objects having a conductive surface are concerned.

By applying retention by means of electrostatic forces on objects having a non-conductive surface, which thereby has to be made conductive by a conductive varnish or by moistening.

When preparing a non-conductive object made of humidity absorbing material, the surface of the object can be made conductive by heating the object to a temperature at which humidity absorbed by the material is produced on the surface thereby forming a conductive layer.

Third, application of the powder, preferably by spraying while the powder particles are electrostatically charged and in such a way that they achieve a good distribution on the object.

Fourth, heating to make the powder particles melt to a leveled layer and adhere to the surfaces of the object.

Fifth, exposing the object to radiation, preferably ultraviolet radiation, thus initiating the curing process.

From this it is evident that the method may be carried out when coating objects made of non-conductive materials.

A polarity difference between the powder and object may, however, be valuable in order to get the powder distributed over all surfaces of the object, especially if it has a complicated configuration. Thus, the method does not require, but does not exclude, any form of charging or neutralization of the object. For instance, when objects made of non-conductive material are to be coated, by applying any of the methods herein disclosed, coating with a conductive varnish, or moistening. Moreover, an electrostatic charge is attained in certain materials when heated, a condition which may be utilized in certain circumstances.

The present invention also comprises a plant for carrying out the method.

In accordance with one embodiment of the present invention there is described a plant for powder coating the surface of objects with polymeric powder having a melting temperature less than about 100° C., the polymeric powder including a polymer curable under the influence of electromagnetic radiation, the plant comprising conveying means for transporting the objects from a first end of the plant to a second end of the plant, the plant divided into chambers by a plurality of walls having openings for the passage of the objects; a first chamber at the first end of the plant including means for preparing the objects to retain the polymeric powder charged with static electricity in a subsequent spraying operation; a second chamber including spraying means for charging the polymeric powder with static electricity and for spraying by compressed air the polymeric powder onto the objects prepared in the first chamber, the second chamber further including means for controlling the temperature in the second chamber during the spraying from about 10° C. to 40° C. and for controlling the humidity of the air in the second chamber from about 20 to 80 percent relative humidity; a third chamber including infrared means for exposing the objects to infrared radiation and heating means for blowing air towards the objects thereby melting the powder retained on the objects, and means for controlling the heating means and the infrared means whereby the surface of the objects are maintained at a temperature no greater than about 100° C.; an airlock before and after the third chamber to prevent heated air escaping from the third chamber and entering an adjacent chamber; and a fourth chamber including means for exposing the objects to electromagnetic radiation to initiate the curing of the polymeric powder, means for blowing air towards the objects, and means for controlling the temperature of the air to be blown from about 5° C. to 40° C.

In accordance with another embodiment of the present invention there is described a plant for powder coating the surface of heat sensitive and humidity absorbing objects with polymeric powder having a melting temperature less than about 100° C., the polymeric powder including a polymer curable under the influence of electromagnetic radiation, the plant comprising an enclosure in the form of a tunnel having a first end and a second end; conveying means for transporting the objects to be coated from the first end of the tunnel to the second end of the tunnel at a transport velocity, the tunnel divided in compartments by means of a plurality of walls having openings to allow the passage of the objects conveyed by the conveying means; a first chamber at the first end of the tunnel for preparing the objects for retaining the polymeric powder in a subsequent spraying operation, the first chamber including means for exposing the objects to infrared radiation to heat the objects thereby producing moisture from humidity absorbed by the objects as condensate on the surface of the objects, the transport velocity of the conveying means being adapted so that the heating effect will prevent the condensate from being substantially vaporized; a second chamber including means for charging the polymeric powder with static electricity, means for spraying the polymeric powder onto the objects by compressed air, and means for grounding the objects having condensate coated surfaces; means for controlling the temperature within the second chamber during the spraying to about 10° C. to 40° C. and the humidity of the air within the second chamber to about 20 to 80 percent relative humidity; a third chamber including infrared means for exposing the objects to infrared radiation and heating means for blowing air against the objects thereby melting the powder retained on the objects, and means for controlling the heating means and the infrared means whereby the surface of the objects are maintained at a temperature no greater than about 100° C.; an airlock before and after the third chamber to prevent heated air escaping from the third chamber and entering an adjacent chamber; and a fourth chamber including means for exposing the objects to electromagnetic radiation adapted to initiate the curing of the polymer, means provided for blowing air against the surfaces of the objects exposed to the electromagnetic radiation, and means for controlling the temperature of the air blown from about 5° C. to 40° C.

In accordance with another embodiment of the present invention there is described a plant for powder coating the surfaces of objects with polymeric powder having a melting temperature below about 100° C., the polymeric powder includes a polymer curable under the influence of electromagnetic radiation, the plant comprising a first station including means for preparing the objects to retain the polymeric powder; a second station including spraying means for spraying the polymeric powder onto the objects prepared to retain the polymeric powder to provide a coating layer of polymeric powder; a third station including tempering means for heating the objects to the melting temperature of the polymeric powder to melt the coating layer of polymeric powder on the objects, the tempering means comprising means for directing a stream of heated air towards the objects and means for generating infrared radiation directed towards the surfaces of the objects; and a fourth station including means for emitting electromagnetic radiation to cure the coating layer of the polymeric powder.

In accordance with another embodiment of the present invention there is described a plant for powder coating the surfaces of heat sensitive objects with a polymeric particulate powder having a low melting temperature and a predetermined flow temperature, the polymeric powder including initiators adapted to initiate curing of the polymeric powder with ultra-violet radiation, the plant comprising a tunnel including conveying means for conveying the objects for polymeric powder coating through the tunnel, the tunnel including a first station including means for exposing the objects to infrared radiation; a second station including spraying means for spraying the polymeric powder onto the surfaces of the objects conveyed through the second station wherein the particles of the polymeric powder are subjected to electrostatic forces to provide a coating layer of melted polymeric powder on the surface of the objects; a third station operative for tempering the coating layer of melted polymeric powder on the surface of the objects comprising heating means for directing a stream of heated air towards the objects and means for exposing the objects to infrared radiation; a fourth station operative for curing the objects with ultraviolet radiation; and temperature control means for adapting the temperature of the airstream in the third station so that the coating layer of melted polymeric powder sprayed onto and retained on the surfaces of the objects in the second station reaches its melting temperature but not its flowing temperature.

In accordance with another embodiment of the present invention there is described a plant for powder coating the surfaces of objects with polymeric powder having a melting temperature less than about 100° C., the polymeric powder including a polymer curable under the influence of electromagnetic radiation, the plant comprising a first chamber in which the objects to be coated are prepared to retain the polymeric powder charged with static electricity; a second chamber in which the objects are sprayed with the polymeric powder charged with static electricity in an atmosphere with the temperature in the range of about 10–40° C. and about 20–80 percent relative humidity; a third chamber in which the objects are heated by exposure to infrared radiation to a surface temperature of no greater than about 100° C. thereby melting the powder retained on the objects and by heated air directed towards the objects, the heated air and the infrared radiation having a temperature adapted to maintain the surface of the objects at no greater than about 100° C.; and a fourth chamber in which the objects are radiated by electromagnetic radiation for initiating the curing of the heated polymeric powder and simultaneously cooled by flowing air having a temperature of about 5° C. to 40° C. for maintaining the objects at a temperature below the melting temperature of the powder thereby compensating for the heating of the objects from the electromagnetic radiation.

In accordance with another embodiment of the present invention there is described a plant for powder coating the surfaces of objects with polymeric powder having a melting temperature less than about 100° C., the polymeric powder including a polymer curable under the influence of electromagnetic radiation, the plant comprising a first chamber for preparing the objects to be coated for retaining the polymeric powder; a second chamber for spraying the objects with the polymeric powder having an electrostatic charge in a first conditioned atmosphere; a third chamber for melting the polymer powder retained on the objects by heating the polymer powder by exposure to infrared radiation and by simultaneously directing heated air towards the objects, the heated air and the infrared radiation having a temperature adapted to maintain the surface of the objects less than about 100° C.; and a fourth chamber for radiating the objects with electromagnetic radiation for initiating the curing of the heated polymeric powder and simultaneous cooling the objects by flowing conditioned air over the objects, whereby the objects are maintained at a temperature below the melting temperature of the polymer powder thereby compensating for the heating of the objects from the electromagnetic radiation.

In accordance with another embodiment of the present invention there is described a plant for powder coating the surface of heat sensitive objects polymer curable under the influence of electromagnetic radiation, the plant comprising a first chamber for storing the objects in an atmosphere having a predetermined relative humidity whereby the objects absorb moisture from the atmosphere, and heating means for pre-heating the objects by infrared radiation until the temperature at the surface of the objects has reached about 40° C. to 85° C. while retaining moisture thereon; a second chamber for spraying the objects in an atmosphere having an air temperature of about 10° C. to 40° C. with the polymeric powder having an electrostatic charge, and means for grounding the objects so that the polymeric powder will be retained at the surface of the objects by means of electrostatic forces, the grounded objects having electrical conducting properties resulting from the moisture produced on the surface of the objects in the first chamber; a third chamber for heating the objects to a temperature at which the polymeric powder melts by simultaneously using infrared radiation and means for blowing air having a predetermined temperature to maintain the surface temperature of the objects at less than about 100° C.; and a fourth chamber for curing the polymeric powder by exposing the surface of the objects to electromagnetic radiation while simultaneously blowing air against the surface of the objects, whereby the temperature of the polymeric powder during the curing is maintained at a temperature not substantially exceeding the melting temperature of the polymeric powder.

BRIEF DESCRIPTION OF THE DRAWINGS

The present invention may be more fully appreciated with reference to the following detailed description which, in turn, refers to the figures which show a schematic illustration of a plant for carrying out the method according to the invention, whereby.

DETAILED DESCRIPTION

Figure 1:
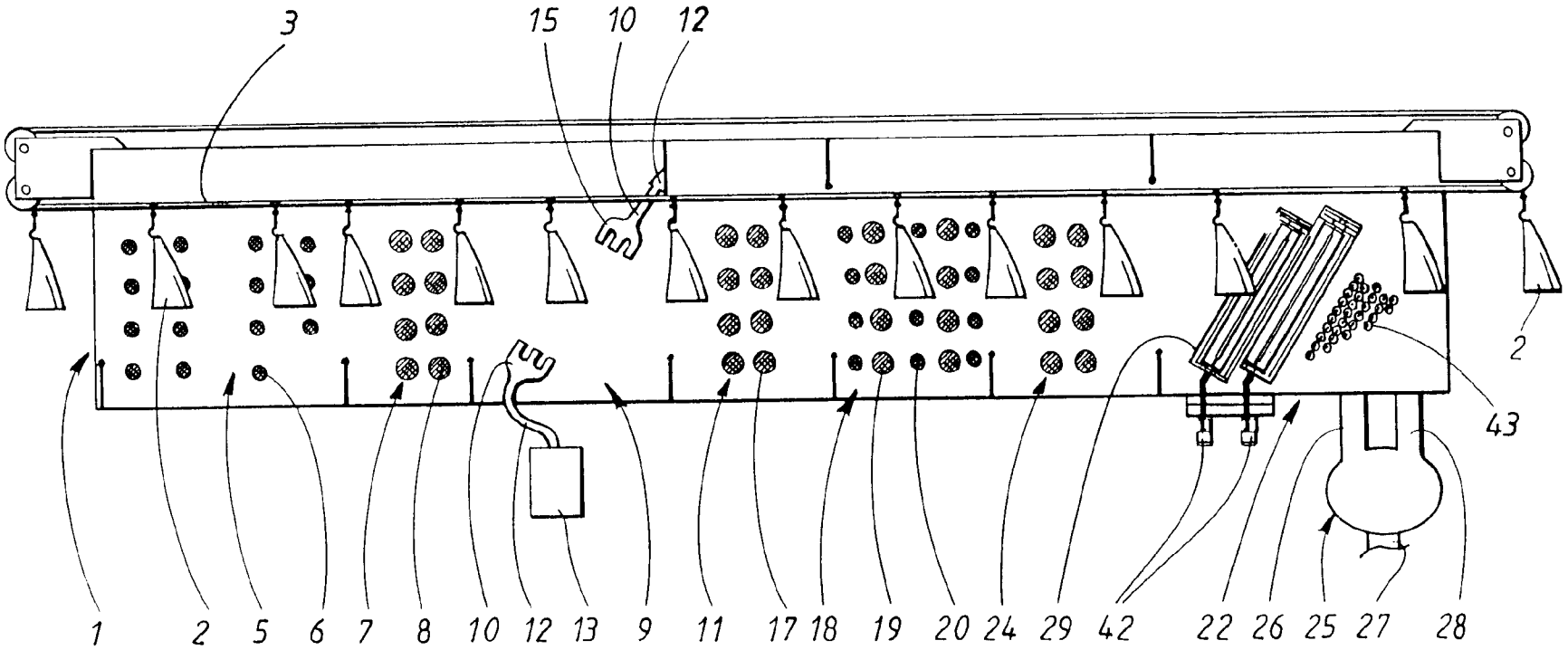
FIG. 1 shows the complete plant in a longitudinal section.

A brief description of the method according to the invention has been disclosed in the introduction of the description. The method comprises a number of main steps that will now be described in greater detail for a preferred embodiment. In the followed preferred embodiment, the main steps have been complemented by a number of sub-steps in order to adapt the method to the special requirements of the embodiment.

In the following preferred embodiment, wood and wood-based materials such as fibre board, chip board inclusive medium density fibre board, and MDF may be powder coated in accordance with the present invention.

Step I

Preparation of Powder

The powder is composed of a polymer, and may be pigmented or non-pigmented for a clear coating, rendering the underlying surface visible, something which is often desired with wooden objects. A principal property of the polymeric powder is that it should have a melting point which is lower than the temperature to which the objects to be coated with the powder should be heated. This temperature limit is partly decided by the properties of the material of the object, since the structure of certain materials changes at a relatively low temperature. For example, the structure of certain thermoplastics changes at temperatures below 100° C. The temperature limit is in part decided by an object's sensitivity to deformation when heated. This heat sensitivity depends on the construction of the object. An object having a compact form is not as easily deformed as disc-shaped or as long slender objects. The heat sensitivity also depends on how homogenous the material in the object is. Certain wood species are very sensitive to deformation when heated.

Other types of heat sensitive objects include products containing heat sensitive components such as hydraulic tools with rubber seals. The principal region for the melting point or the softening point of the powder may be about 60–100° C.

As can be understood by the following description, it is not necessary for the object to be through-heated to the melting temperature of the powder, but only its surface, though to such a depth that the temperature is fairly uniformly distributed on the object. With the expression "the melting temperature of the powder" it is not intended that the powder material has to become fluid, but in many cases it is sufficient that it has reached such a degree of softening that it is leveled out and adheres to the intended surface of an object to be coated.

The fact that only the surface has to be heated and that the temperature may be kept low is advantageous when powder coating objects which certainly can endure a higher temperature, but for which it is disadvantageous to heat to a higher temperature. This is the case, for instance, when objects of conductive material are concerned, in which the heat rapidly spreads inwards. For example, solid cast iron objects require a considerable heating time with large energy consumption if methods other than the present invention are utilized.

Another principal property which the powder material should possess is that its curing can be initiated by electromagnetic radiation. According to the present state of the art, it is most advantageous to use ultraviolet (UV) radiation and to adapt the polymeric powder to this. Although UV radiation is discussed in the preferred embodiment, other electromagnetic radiation may be used in accordance with the present invention. Additionally, combinations of different types of radiation may be useful in practicing the present invention.

Good leveling at a low melting temperature may be obtained because the powder is at least partly composed of polymers such as polyester, in addition to leveling agents.

Curing by ultraviolet radiation within the wavelength range 350–400 nm may be attained if polymers in a known way are admixed with initiators.

These are only examples of how these properties may be attained and there are also other powder compositions which may exhibit the desired properties. A clear layer which does not conceal the underlying surface is obtained after curing from a polymer powder containing no pigmentation or dyes. If a non-transparent layer is desired, such as opaque, white, black or colored, pigments or other dyestuffs may be added.

Gloss of the coated surface may be controlled by means of additives. However, such additives may also produce changes in the necessary properties of low melting point and possibility for UV curing. These factors must be taken into account when composing the powder and when implementing the method.

Step II

Preparation of the Object in Order to Retain the Powder on its Surface

In this step, the object to be powder coated is pre-heated. The object is assumed to have a limited heat resistance; typical of such are wooden objects, pressed objects such as woodfibre-board or plastic objects, and thereby also made of reinforced plastics and/or with a high addition of filler. The fact that a material has a low heat resistance, such as wood and a majority of plastics, generally also implies that it is non-conductive. Materials having high heat resistance are typically construction metals, which are conductive. Conventional powder coating methods generally presume objects with a conductive surface, however the present invention is not limited to such objects but may advantageously be applied to objects having non-conductive surfaces and no pretreatment for achieving conductive properties has to take place. This makes the method particularly valuable. However, as earlier mentioned, the method may also be applied to solid objects, e.g. cast iron bodies, in order to reduce the energy consumption for heating.

The pre-heating may be done in different ways: convection by heat air flow, infrared radiation, or in exceptional cases, such as when plates are to be coated only on one side heating by conduction from heated surfaces. Particularly useful is a method in which simultaneous heating take place by convection of an air stream and by IR radiation. The IR radiation gives a rapid and comparatively deep heating of the surfaces it strikes. The air flow gives a temperature that is very uniformly distributed over the surfaces of the object. This is also useful with objects having a very complicated outer shape and when IR radiation does not reach all surface sectors.

As previously mentioned in the Summary of the Invention, one way to retain the powder in the spraying operation is to pre-heat the object to a temperature so high that the powder hitting the surface of the object will partially melt and stick to the surface. However, this will not work when coating heat sensitive objects which cannot be heated to a temperature considerably over 100° C. If the object is pre-heated to a lower temperature this cannot be kept until the object is moved to the place where the powder spaying is performed. If, on the other hand, the powder is prepared to have a very low melting point, there will be considerable risk that the powder particles will stick together during storing and transport to granules impossible for use in the spraying operation. Therefore, pre-heating by melting the powder particles by the application will not work when coating heat sensitive materials such as wood and wood-based materials.

In another embodiment of the present invention directed towards powder coating of materials that absorb atmospheric humidity to some extent, such as wood and wood-based materials, pre-heating is done but not adapted for obtaining melting and sticking of the powder during the spraying. In connection with the development of the invention it has been established that for non-conductive materials, retaining of a powder will be obtained after preheating if the objects are neutralized by means of grounding. The effect is thereby that the heating will produce humidity on the surface of the object which form condensate making the surface conductive. To get this process work it is necessary to control certain factors: the humidity of the product, the heating process so that condensate will be produced, but not overheating of the object so that the condensate will be completely vaporized. It is also necessary that movement of the object to where it will be sprayed with powder is made under such conditions that the conductive properties will be maintained.

The pre-heating takes place in a chamber, established for that purpose, in a plant where the objects to be coated may be transported between different chambers or work stations intended for carrying out the method steps of the present invention. Further, see the description of the plant.

Step III

Powder Spraying

After preheating has been performed, if such is applied, the respective objects are transported to a chamber where the powder may be sprayed on. This is conveniently accomplished by means of spray guns, arranged in such a way that the surfaces which are to be coated may be struck by the powder. The guns are also arranged to charge the powder with an electrostatic charge. It is previously known to use a high voltage driven charging device, so that the powder, during its journey through the spraying equipment, is charged by friction against walls made of material adapted for that purpose. The charge will make the powder granules repel each other, whereby particle clouds can be attained to encompass the object.

The spraying has to be performed in a controlled environment. As previously mentioned, the temperature cannot be too high because low-melting powder is very sensitive to being sticky so that larger granules will be formed. The temperature range should be about 10–40° C., and preferably about 15–25° C. in the spraying chamber. A temperature near the common room-temperature, about 20° C. or even lower, may also be preferred. It is also important to control the humidity of the air. The relative humidity should be in the range of 20–80 percent relative humidity, and preferably about 50–60 percent in the spraying chamber.

For an object that is not heat sensitive, the temperature may be maintained at least as high as the melting or softening temperature of the powder until the spraying step. The particles will arrive in a tacky state and be deposited on the surface of the object when they impact the object. In this manner, the respective objects receive a covering, but without reflow and uncured, layer of the polymer-based coating material.

To preheat the object to a temperature so that the powder melts at the spraying will be very difficult or impossible and cannot be done when powder coating heat sensitive material such as wooden wood-based materials. The above described retaining process will, therefore, only be applicable under certain conditions where it is possible to heat the object to a temperature much over 100° C.

If pre-heating is done to a temperature considerably over the mentioned temperature adapted to the spraying operation, it is necessary to divide the pre-heating and spraying chambers by means of an airlock so that heated air from the pre-heating chamber will not reach the spraying chamber to such an extent that it will disturb the spraying process.

If pre-heating to the melting temperature of the powder cannot be done, the retaining of the powder has to be accomplished by utilizing electrostatic forces by charging or grounding the object. Charging can be accomplished by exposing the object to an electrostatic field which preferably is made before the object reaches the spraying chamber.

If neutralization by grounding should be used it is, as mentioned before, necessary that the surface of the object has conductive properties, which can be done by conductive varnish damping. A preferred method for atmospheric humidity absorbing materials is the herein described pre-heating adapted to produce condensate on the surface of the object. When neutralization is utilized, it is necessary that the objects are grounded when they are passing the spraying operation. Preferably, this can be done by having the conveying means in contact with the objects.

Step IV

Heating to the Melting Temperature of the Powder

As is evident from the earlier description, heating takes place after the application of the powder. Through heating, the powder granules flow together in order to form a uniform layer. If the temperature on the object has been kept low, because it must not be exposed to a higher temperature, this post-heating must be performed in such a way that the applied layer is heated sufficiently while the underlying object shall be heated as little as possible. Accordingly, the heating may be undertaken by means of a rapid process involving IR radiation, conveniently in combination with a heated air flow in a short process. This heating by means of IR radiation and heated air will be further described herein.

Complementary Step

Intermediate Tempering

Curing through UV radiation now remains in order to obtain a finished coating. At least in certain cases it may, however, be desirable to adjust the condition of the applied, sticky coating layer. Such an adjustment of the layer may be done by means of cooling.

In certain cases there might be a risk that after heating the layer reaches such a fluent state that there is a risk of running and drop-forming at protruding edges because of continued heating by means of conduction from the heated object. In order to prevent this, cooling may be undertaken, thus lowering the temperature which was necessary for melting the powder particles, to a temperature where the formed layer obtains a more solid state.

Step V

Curing

When conventional powder coating is concerned, as earlier mentioned, the polymerization of the powder material is done by means of heating, as a rule in a convection oven. The heating thereby at first leads to a fusion of the material while the powder granules are initially retained by means of electrostatic forces. After this, the curing, which is initiated by the heating, takes place.

The present method is aimed at carrying out the process at such a low temperature that no curing will be attained by the heating or, in any case, would require such a long time after initiation that it would be unfeasible in an industrial process.

Accordingly, the curing must be accomplished in another way; that is, by means of initiation of the curing process by ultraviolet radiation. Under Step I, it has been described how the powder material is prepared for such a curing.

The curing should take place at different UV wavelengths, depending on how the powder is pigmented and which photoinitiator has been added. A UV spectrum situated in the lower region, 250–350 nm, is convenient, whereby it is assumed that a photoinitiator which absorbs within this range is utilized. There are also lamps having a maximum at 350–400 nm and at 400–450 nm and there are also photoinitiators which absorb at these large wavelengths. One may also pigment a UV-curing powder coating in many different ways. The pigment must in all cases be adapted to the right photoinitiator and lamp.

High intensity lamps may imply that it is easier to cure thick layers and to increase the curing rate. The object which is to be cured does not have to be in focus but the intensity at a certain distance might be sufficient. This is especially evident when a clear coating is concerned, however, for pigmented systems it is more important that the intensity be as high as possible.

The UV curing takes place in a curing chamber adapted for that purpose. The objects are brought into the curing chamber after the powder spraying and the optional intermediate tempering. In the curing chamber, a number of UV radiators are arranged from which the radiation should reach all coated surfaces of the object. For certain objects having a complicated shape and a coating on many different sides, special layouts may be necessary. Thus, it may be necessary to arrange a large number of UV radiators directed in different ways. The UV radiators may be complemented with mirrors for redirecting the radiation at new angles. The UV rays could also be made to move around the respective objects. Optionally, the objects may be rotated or moved in another way in front of the radiation sources.

When the radiation strikes the coating layer, the initiator system of the material will start the polymerization. It is thereby possible to conduct this very rapidly; times as fast as 2 seconds are possible. The short processing time in relation to the time for heat curing offers important advantages in industrial production such as a faster flow-through of work pieces and a reduced length of the plant in relation to what is necessary for a curing oven.

In most cases cooling may take place simultaneously with the UV radiation. By means of an adapted cooling, the temperature during the curing may be prevented from reaching disadvantageously high numbers because of energy contribution from the flow of heated objects, and particularly because the lamps for the UV radiation will also emit IR radiation. Such cooling during the UV radiation is assumed in the present embodiment, further see the description of the plant.

After Step V and a possible cooling down to room temperature, the process according to the method is terminated and the objects have obtained a cured coating. Accordingly, all advantages which are associated with powder coating, namely the possibility of achieving larger layer thickness and higher mechanical resistance, as compared to wet painting, have been reached. The method is also very environmentally friendly since no solvents need be used, and because powder, which in the spraying step has not struck the object, may be collected in the spraying chamber in order to be reused.

The attached drawings show a plant wherein the method steps of the present invention may be carried out in a rational, industrial process.

Referring to the drawings, in which like reference numerals reflect like elements thereof, FIG. 1 shows a plant having the form of a tunnel 1 through which the objects 2 which are to be treated may be brought by means of a suspended conveyor 3, the transporting portion of which travels in a direction from the left to the right in the figure. The tunnel 1 is shown in a longitudinal cross-section. It is thus evident that it is divided into a number of compartments among them four chambers, each being adapted for the realization of one of Steps II–V: pre-heating, spraying, heating and curing. Preparation of the powder, Step I, is not included in the plant because the powder is assumed to be added in a state of preparation ready for use in the plant.

Preparing the objects for retention of the powder, Step II, is in the preferred embodiment presupposed to be made by preheating in a pre-heating chamber 5. This chamber exhibits radiators 6 for infrared light. It may also be provided with inlet openings 7 for heated air from a combined heating and blower set (not shown).

In one embodiment, directed towards powder coating of heat sensitive, atmospheric humidity absorbing materials, the pre-heating has to be controlled very carefully as previously described. Therefore, the pre-heating chamber is adapted to give the objects a heating intensity and passing time during the moving by the conveyor so that humidity will be produced as condensate on the surfaces of the objects. It has been shown that heating by means of infrared light emitting radiators will give the best result. It is thereby possible to adapt the heating of the objects shape and volume and the transport velocity so that condensate will be produced on the surfaces of the objects but will not be completely vaporized by means of overheating. Heating by heated air could result in drying of the surfaces so they will no longer be conductive. Therefore, the pre-heating chamber 5 may only be provided with IR emitting radiators. If the humidity absorbing material has been stored for some time in an atmosphere with at least 40 percent relative humidity, the content of moisture will in most cases be sufficient for forming the condensate layer necessary for retaining the powder.

An airlock 7 is provided after the pre-heating chamber. The airlock consists of a chamber in which hot air escaping from the pre-heating chamber 5 is evacuated by means of ventilation openings 8.

A spraying chamber 9 is provided after the airlock 7. Inside the spraying chamber 9, there are placed a number of spray guns 10 which via hoses 12, are connected to a powder container 13. The spray guns may, as shown, each be furnished with several spray nozzles 15. By means of a pressurized air driven system, the powder from the container 13 may be sucked up through the hose 12 to the respective gun 10 in order to be sprayed out by means of the nozzles 15. In this context, it is assumed that inside the spray guns there are channels made of a material, for example, polytetrafluoroethylene, which because of friction between the walls and the powder lends the powder an electrostatic charge. Optionally or supplementary, the guns may be provided with charging surfaces which are supplied with high voltage electrical current.

The climate in the spraying chamber 9 is controlled so that the temperature will be about 10–40° C., and preferably 15–25° C., and the relative humidity about 20–80 percent, and preferably 50–60 percent relative humidity. This is accomplished by means of airlocks on both sides of the spraying chamber 9, the before mentioned airlock 7 preventing hot air from escaping into the spraying chamber 9 from the pre-heating chamber 5 and a further airlock 11 after the spraying chamber 9. If the plant is working in an environment where the temperature and humidity are not within the mentioned limits, the spraying chamber 9 has to be provided with temperature and humidity control means.

After the airlock 11 is a heating chamber 18. The heating chamber 18 is provided with both inlet openings 19 for heated air from heating and blowing means, and with infrared light emitting radiator 20. It is important that the objects will reach a temperature adapted to melt the powder retained by the objects without heating the material of the objects to a temperature at which the objects are damaged. For heat sensitive objects, the powder coating of which the plant is appropriate for, the temperature may be about 100° C. and very well distributed over all surfaces coated by the powder. It is also important that the heating and thereby the melting of the powder will by accomplished as fast as possible. The speed of the conveyor has to be adapted to the spraying operation and a short heating time in the heating chamber 18 will result in a short chamber and thereby a less space for containing the plant.

IR radiation provides an intense heating, but tends to overheat some portions of objects, e.g., thin areas, edges and points, while thicker portions not will reach the pre-decided temperature. Therefore, the air blown on the objects will level out the temperature differences by cooling the overheated portions, and further heating the underheated portions. The air blown into the heating chamber 18 may have a temperature about or less than the pre-determined end temperature of the surfaces of the objects. A blowing and heating apparatus 19, 20 is provided for supply of heated air in the heating chamber 18. The heated air may be recirculated to save energy.

Another airlock 24 follows the heating chamber 18 for collecting hot air escaping from the heating chamber 18.

A curing chamber 22 follows airlock 24 for Step V, the curing step. A number of radiators in elongated tube shape for UV radiation are inserted into the curing chamber 22. As previously mentioned, mirrors for redirecting radiation may also be placed in the curing chamber 22. The walls of the curing chamber 22 may also be reflective.

In order to keep the temperature constant or to allow cooling, the curing chamber 22 has inlet openings for air from a blowing apparatus 25. This air may be collected partly from a return line 26 from the curing chamber, and partly from an inlet 27 from a source of air with a temperature corresponding to or lower than the lowest temperature which is assumed to be required from the cooling air through the openings. This source may be the ambient atmosphere if the ambient temperatures are sufficiently low, or air from a refrigerating machine. For example, an air temperature in the range of about 5–40° C. and preferably about 15–25° C. is contemplated. Furthermore, there is an outlet 28 for air from the curing chamber, in case the discharged air is not completely going in return and in through the openings, but is completely or partially replaced by air from the inlet 26. The proportions, between return air supplied through the openings and fresh air from the inlet 26 are controlled by a thermostat-controlled throttle in order to keep the temperature inside the chamber constant at the temperature most suitable for the process.

For heat sensitive objects, it is very important that they are protected from being overheated. It is desirable that the objects will not be heated to a temperature over the temperature necessary for melting the powder and it is best if the objects are cooled to a temperature at which the melted power has been solidified and is forming an even coating on the objects. On the other hand, it is advantageous if the temperature is not too low during the subsequent radiation curing because the molecules of the polymer have increased movability at higher temperatures which facilitate the polymerization initiated by the radiation. Therefore, the temperature of the coating and the surface layer over the objects may have a temperature in the range of 15–50° C., and preferably about 20–30° C. Such cooling after heating in the heating chamber 18 is done by providing the airlock 24 with ventilation means blowing air the temperature which is adapted to cool the objects to the desired temperature.

It cannot be avoided that heat is accumulated during the continuous coating process, giving rise to a heat increase which has to be controlled, since the heated objects which are brought in provide a continuous heat contribution. Simultaneously it cannot be avoided that the radiators 19 emit a certain waste energy in the form of IR radiation and the UV radiation itself provides an energy contribution.

Figure 2:
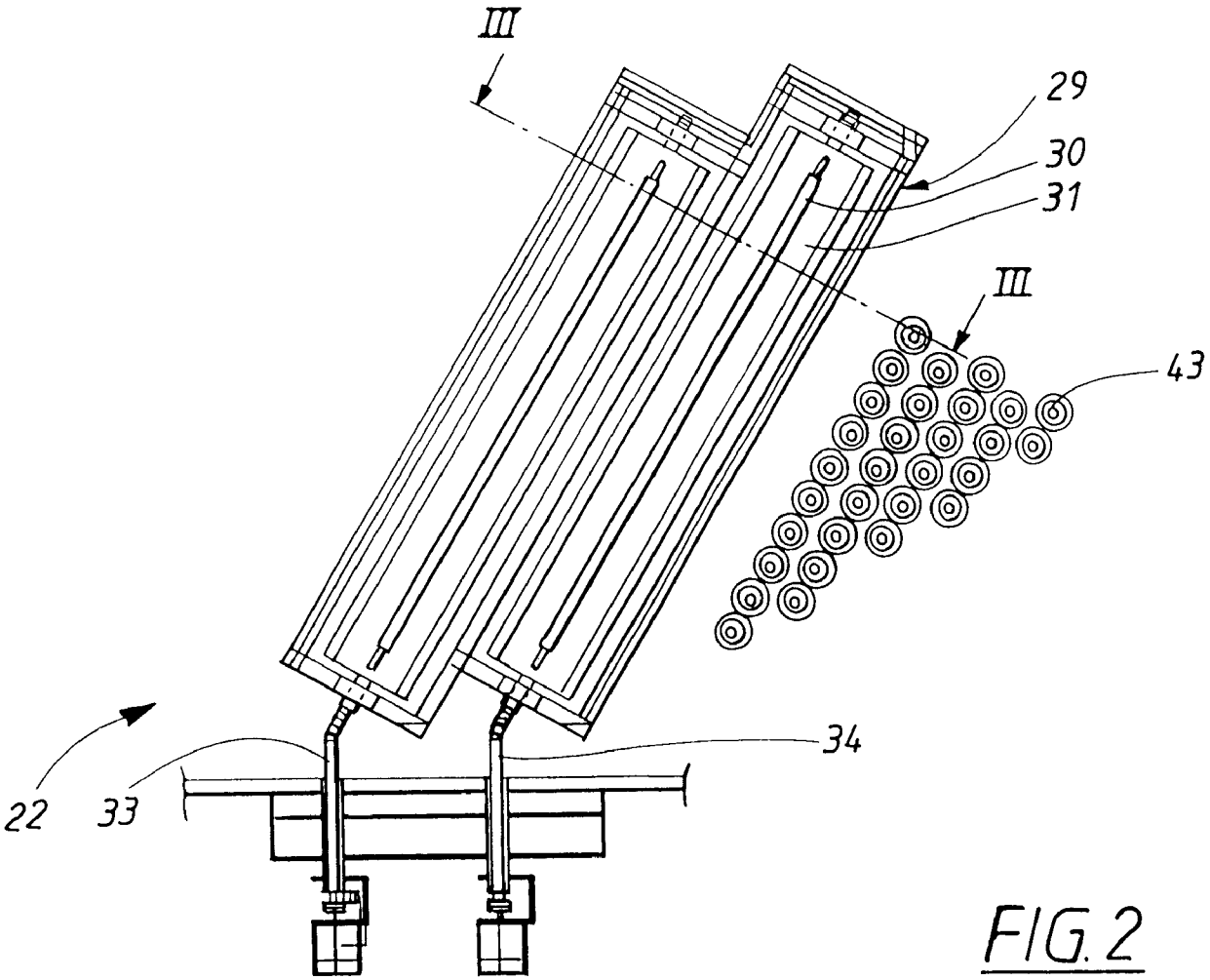
FIG. 2 shows the curing chamber of the plant.

The one wall of the after the airlock and cooling chamber 24 following the curing chamber 22 is shown in FIG. 2 in larger scale than in FIG. 1, and in a more detailed illustration.

On a wall of the curing chamber 22 shown in FIG. 2, two radiation devices 29 are mounted. On the opposite wall of the curing chamber formed in the tunnel-shaped coating plant two further radiation devices are mounted so that the objects 2 to be treated will pass between the two arrangements of radiation devices when conveyed through the tunnel-shaped coating plant. The radiation devices are elongated and mounted in an oblique angle relative to the moving direction. Thereby the objects will be more continuously exposed to the radiation compared to an arrangement with the devices being mounted transverse to the moving direction.

Figure 3:
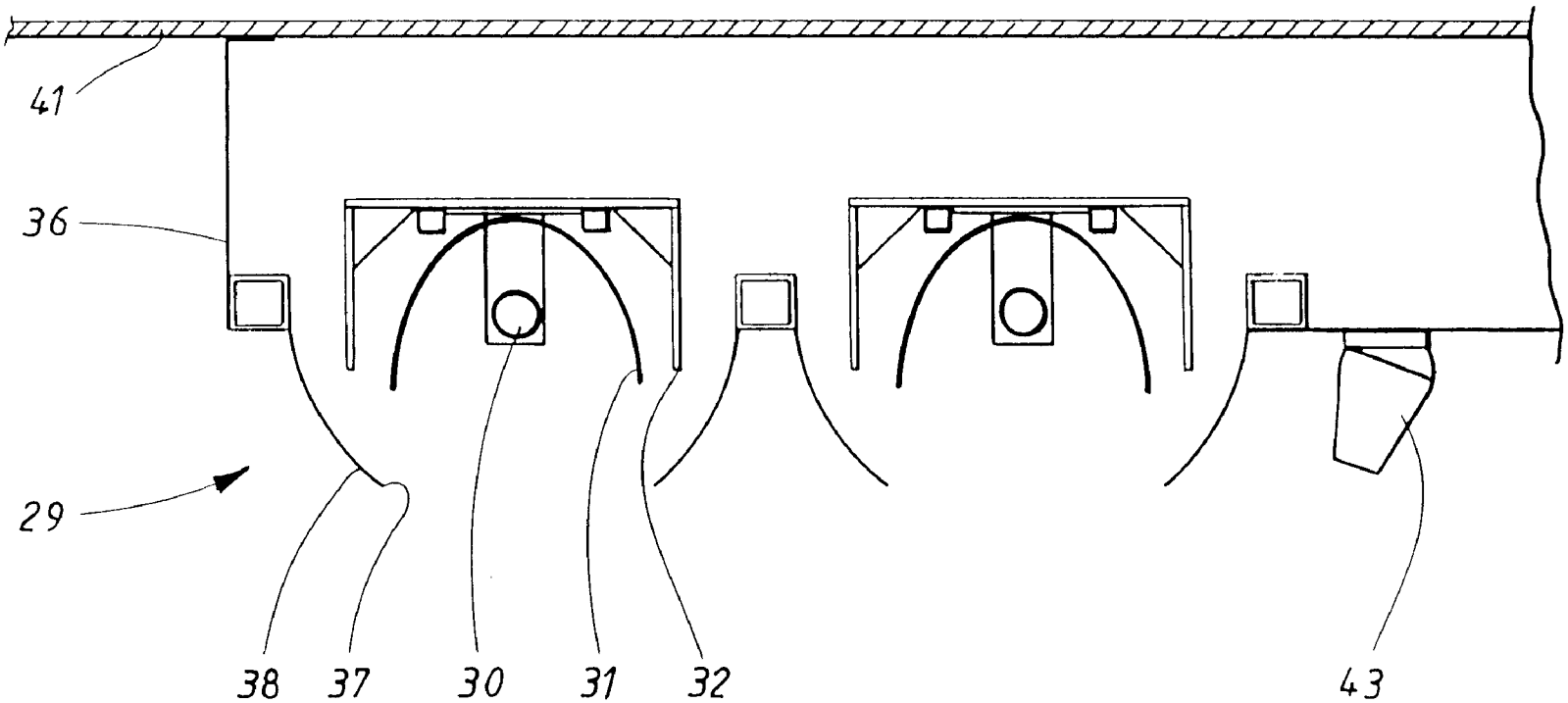
FIG. 3 shows the curing chamber in FIG. 2 in a cross-section along the line III—III in FIG. 2.

Each device 29, as shown in FIG. 3, which is a cross-section of the device along the line III—III in FIG. 2, comprises an elongated tube 30 being the emitting element. In one embodiment, the tube is an ultraviolet radiation emitting lamp. A reflector 31 is mounted in a housing 32 behind the tube 30 which is rotatable around shafts 33 and 34 having their axes coaxial to the tube 30. The housing 32 is in turn mounted into an airbox 36 attached to the wall 41 of the chamber. The airbox has openings 37 in front of each of the tube housing. Air deflectors 38 are provided at each of the openings 37. The airbox 36 is connected to a blowing apparatus 25. The blowing apparatus is provided to blow air into the airbox 36 and out through the openings 37 in front of the respective tubes 30. The temperature of the air should be relatively low. Room-temperature, around 20° C. or somewhat lower, is suitable. If necessary, the blowing apparatus will include cooling means provided to produce air with the pre-decided temperature.

In FIGS. 2 and 3 the rotatable housing 32 is shown in its working position in which the tube 30 is emitting the radiation through the opening 37 of the airbox towards the object directly and reflected from the reflector 31. As mentioned, the housing 32 is rotatable and by rotation of the housing it can be turned 180° so that the radiation will be directed towards the back wall of the airbox 36 mounted on the chamber wall. The rotation can be activated by means of pneumatic motors 42.

As evident from FIG. 2 there are a number of air nozzles 43 provided in the wall of the chamber and also in the opposite wall of the chamber. These air nozzles are connected to the blowing apparatus 25 and are directed so that the air blown out will hit the passing objects after they have passed the radiation devices 29.

When carrying out the method in the described plant the objects are suspended in turn on the transporting portion of the conveyor 3. At first the objects are brought in turn into the pre-heating chamber 5. Consequently, the conveyor moves with a speed adapted to the length of time required for the treatment step in order to thereby achieve a sufficient dwell time in the respective chambers. In the pre-heating chamber 5, the objects are exposed to IR radiation from the radiators 6. This leads to heating which is well distributed over the surface of the objects. If objects that are not heat sensitive are to be treated, the heating may be done at temperatures high enough to obtain the retention of the powder by melting the powder in the spraying step.

In embodiments directed towards coating heat sensitive humidity absorbing material such as wooden and wood based products, the heating has to be limited so that the objects will produce moisture condensing at the surfaces, but not heated to the extent that this condensate will vaporize, thus leaving the surfaces dry.

As described before, preparing of the objects for retaining the powder in the spraying step has to be adapted to each kind of object and its material. Therefore, the pre-heating chamber 5 can be provided for processes in addition to heating such as those previously described.

After the objects have passed the air lock 7, the powder spraying is performed in the spraying chamber 9. It should be evident from the preceding description how this is performed with the aid of the spray guns 10. These generally have to be adapted to the object in question, when it comes to their positions and often also to their design, for instance the number of nozzles. In certain cases, it might be necessary to suspend the spray guns in a movable way, making them execute a movement pattern during the spraying.

After the airlock 11 protecting the spraying chamber 9 from being influenced from heat in the heating chamber 18, the objects will reach heating chamber 18 for heating to reflow and sticking of the powder on the surfaces of the objects. As described in the foregoing, the heating is effected by means of both IR radiation, which will give a rapid heating, and by blowing air heated to about the decided end temperature of the objects surfaces, which will equalize the temperature over the surfaces. Thereby, a rapid heating will be accomplished without any risk of underheating or overheating of certain portions of the objects.

In the airlock 24 the heated air escaping from the heating chamber 18 will be blown back to this chamber and cooler air is blown around the objects in order to stabilize the melted powder layer and for preventing overheating in the next step, the radiation curing.

In the curing chamber 22, finally, curing is initiated by means of radiation from the UV radiators 29. After the irradiation or in connection therewith, a certain curing time may be necessary, and the curing chamber 22 is conveniently extended in such a way that the layer is stabilised when the objects leave the chamber.

As is evident from the description of the curing chamber 22, it may be necessary to control the temperature during a continuous manufacturing process by means of cooling. It is especially important to control the temperature in the curing chamber 22. The radiation means, in the embodiment the tubes 29, will produce by sides the UV radiation for initiation of the curing and also IR radiation effecting heating of the objects. Therefore the UV radiation is effected by simultaneous cooling by air from the airbox 36 by means of the deflectors 38 directed towards the objects in the areas which are UV radiated from the tube 30.

The unintended heating in the curing chamber 22 is controlled, so that the objects not will be damaged, by cooling and by limiting radiation exposure time. This time depends on the velocity with which the objects are passing the radiation when being conveyed. If, for some reason, the conveyor 3 should stop, heat sensitive objects may be seriously damaged. Switching off the electric current will not be sufficient in such a situation because the IR radiation not will stop immediately. Another reason to make the UV radiation devices rotatable is that for some types of UV lamps the life will be decreased for each switch off. Therefore, a shadowing of the lamps may be preferable for economical reasons.

In order to prevent every risk for overheating the arrangement described with the rotatable housing for the tube is provided. If the conveyor stops or conveying velocity decreases, the motors 42 will be activated and rotate the housing 32 180° so that the radiation will be directed towards the back wall of the airbox 36 and no radiation will reach the object. The same activation of the motors 42 may also be effected if the blowing of cooling air stops. As mentioned, the motors 42 are of the pneumatic type. Their function will thereby not depend on supply of electric current. It is presumed that the conveyor, as well as the blowing apparatus, are driven by electrical energy. If the energy supply breaks down and the conveyor and blowing apparatus stop, this will not interfere with the function of the pneumatic motors and they will effect the rotation of the tube housing.

The herein described method and plant for coating of heat sensitive objects are described as a preferred embodiment and further an embodiment of certain interest. However, other embodiments may be included within the scope of the attached claims. In the preamble it has been mentioned that the retention of the powder applied on the surface of the object may be take place in other, known ways than by a preheating of the objects. In cases concerning objects with a conductive surface, the sticking of the powder onto the objects may very conveniently be done by means of electrostatic forces, while the melting of the powder which is necessary for the process in that case is achieved by means of a post-heating without requiring the objects to be preheated.

Consequently, the method as well as the plant may be adapted in a multitude of different ways to the prevailing requirements and the types of objects which are to be treated, and to the material of these. Common to all its embodiments is, however, that a fusion of a powder, which is fusible at a low temperature, is applied, thus bringing about the formation of a polymer layer on the surface of the respective objects which are to be coated, whereafter the curing takes place by means of radiation without any substantial temperature increase. Throughout the process a temperature is thus maintained which is considerably lower than that which has earlier been practiced within the field.

Although the invention herein has been described with reference to particular embodiments, it is to be understood that these embodiments are merely illustrative of the principals and applications to the present invention. It is therefore to be understood that numerous modifications may be made to the illustrative embodiments and that other arrangements may be devised without departing from the spirit and scope of the present invention as defined by the appended claims.

What is claimed is:

1. Plant for powder coating the surface of objects with polymeric powder having a melting temperature less than about 100° C., said polymeric powder including a polymer curable under the influence of electromagnetic radiation, said plant comprising:

conveying means for transporting said objects from a first end of said plant to a second end of said plant, said plant divided into chambers by a plurality of walls having openings for the passage of said objects;

a first chamber at said first end of said plant including means for preparing said objects to retain said polymeric powder charged with static electricity in a subsequent spraying operation;

a second chamber including spraying means for charging said polymeric powder with static electricity and for spraying by compressed air said polymeric powder onto said objects prepared in said first chamber, said second chamber further including means for controlling the temperature in said second chamber during said spraying from about 10° C. to 40° C. and for controlling the humidity of the air in said second chamber from about 20 to 80 percent relative humidity;

a third chamber including infrared means for exposing said objects to infrared radiation and heating means for blowing air towards said objects thereby melting the powder retained on said objects, and means for controlling said heating means and said infrared means whereby the surface of said objects are maintained at a temperature no greater than about 100° C.;

an airlock before and after said third chamber to prevent heated air escaping from the third chamber and entering an adjacent chamber; and a fourth chamber including means for exposing said objects to electromagnetic radiation to initiate the curing of said polymeric powder, means for blowing air towards said objects, and means for controlling the temperature of said air to be blown from about 5° C. to 40° C.

2. The plant as claimed in claim 1, wherein said temperature in said second chamber during said spraying is from about 15–25° C.

3. The plant as claimed in claim 1, wherein said humidity of said air in said second chamber is from about 50 percent to 60 percent relative humidity.

4. The plant as claimed in claim 1, wherein said temperature of said air to be blown in said fourth chamber is about 15–25° C.

5. The plant as claimed in claim 1, wherein said infrared means and said heating means in said third chamber maintains the surface of said objects less than about the melting temperature of said powder.

6. Plant for powder coating the surface of heat sensitive and humidity absorbing objects with polymeric powder having a melting temperature less than about 100° C., said polymeric powder including a polymer curable under the influence of electromagnetic radiation, said plant comprising:

an enclosure in the form of a tunnel having a first end and a second end;

conveying means for transporting said objects to be coated from said first end of said tunnel to said second end of said tunnel at a transport velocity, said tunnel divided in compartments by means of a plurality of walls having openings to allow the passage of said objects conveyed by said conveying means;

a first chamber at said first end of said tunnel for preparing said objects for retaining said polymeric powder in a subsequent spraying operation, said first chamber including means for exposing said objects to infrared radiation to heat said objects thereby producing moisture from humidity absorbed by said objects as condensate on the surface of said objects, said transport velocity of said conveying means being adapted so that the heating effect will prevent the condensate from being substantially vaporized;

a second chamber including means for charging said polymeric powder with static electricity, means for spraying said polymeric powder onto said objects by compressed air, and means for grounding said objects having condensate coated surfaces;

means for controlling the temperature within said second chamber during said spraying to about 10° C. to 40° C. and the humidity of the air within the second chamber to about 20 to 80 percent relative humidity;

a third chamber including infrared means for exposing said objects to infrared radiation and heating means for blowing air against said objects thereby melting the powder retained on said objects, and means for controlling said heating means and said infrared means whereby the surface of said objects are maintained at a temperature no greater than about 100° C.;

an airlock before and after said third chamber to prevent heated air escaping from said third chamber and entering an adjacent chamber; and a fourth chamber including means for exposing said objects to electromagnetic radiation adapted to initiate the curing of the polymer, means provided for blowing air against the surfaces of said objects exposed to the electromagnetic radiation, and means for controlling the temperature of the air blown from about 5° C. to 40° C.

7. The plant as claimed in claim 6, wherein said temperature in said second chamber during said spraying is about 15–25° C.

8. The plant as claimed in claim 6, wherein said humidity of said air in said second chamber is about 50 to 60 percent relative humidity.

9. The plant as claimed in claim 6, wherein said temperature of said blown air in said fourth chamber is about 15–25° C.

10. The plant according to claim 6, wherein said means for exposing said objects to electromagnetic radiation includes an airbox within said fourth chamber, a housing having at least one elongated tube-shaped radiation emitting lamp within said airbox, and means coupled to said airbox for blowing air into said airbox.

11. The plant according to claim 10, wherein said housing includes a reflector mounted to said housing for directing the radiation emitted from said lamp towards said objects, said reflector provided to rotate between a position wherein the radiation is directed towards said objects and a position wherein said reflector is shadowing said objects from being irradiated in order to prevent said objects from being overheated.

12. The plant according to claim 10, wherein said means for exposing said objects to electromagnetic radiation includes an airbox within said fourth chamber, a housing having at least one elongated tube-shaped radiation emitting lamp within said airbox, and means coupled to said airbox for blowing air into said airbox.

13. The plant according to claim 12, wherein said housing includes a reflector mounted to said housing for directing the radiation emitted from said lamp towards said objects, said reflector provided to rotate between a position wherein the radiation is directed towards said objects and a position wherein said reflector is shadowing said objects from being irradiated in order to prevent said objects from being overheated.

14. The plant as claimed in claim 6, wherein said infrared means and said heating means in said third chamber maintains the surface of said objects less than about the melting temperature of said powder.

15. Plant for powder coating the surfaces of objects with polymeric powder having a melting temperature below about 100° C., said polymeric powder includes a polymer curable under the influence of electromagnetic radiation, said plant comprising a first station including means for preparing said objects to retain the polymeric powder; a second station including spraying means for spraying the polymeric powder onto said objects prepared to retain said polymeric powder to provide a coating layer of polymeric powder; a third station including tempering means for heating said objects to the melting temperature of the polymeric powder to melt the coating layer of polymeric powder on said objects, said tempering means comprising means for directing a stream of heated air towards said objects and means for generating infrared radiation directed towards the surfaces of said objects; and a fourth station including means for emitting electromagnetic radiation to cure the coating layer of the polymeric powder.

16. The plant according to claim 15, wherein said first station is operative for pre-heating said objects to a sufficient temperature such that said polymeric powder at least partly melts and adheres to said objects.

17. The plant according to claim 15, wherein said third station includes means for directing a stream of air towards said objects wherein the temperature of the air is controlled to keep said coating layer of polymeric powder below the flowing temperature of the polymeric powder.

18. The plant according to claim 15, further comprising conveying means for conveying objects to be powder coated through the first, second, third and fourth stations.

19. The plant according to claim 15, wherein the melting and softening temperature of said polymeric powder is between 60–100° C.

20. Plant for powder coating the surfaces of heat sensitive objects with a polymeric particulate powder having a low melting temperature and a predetermined flow temperature, said polymeric powder including initiators adapted to initiate curing of the polymeric powder with ultra-violet radiation, the plant comprising a tunnel including conveying means for conveying the objects for polymeric powder coating through the tunnel, said tunnel including:

a first station including means for exposing the objects to infrared radiation;

a second station including spraying means for spraying the polymeric powder onto the surfaces of said objects conveyed through the second station wherein the particles of the polymeric powder are subjected to electrostatic forces to provide a coating layer of melted polymeric powder on the surface of said objects;

a third station operative for tempering the coating layer of melted polymeric powder on the surface of said objects comprising heating means for directing a stream of heated air towards said objects and means for exposing said objects to infrared radiation;

a fourth station operative for curing said objects with ultraviolet radiation; and temperature control means for adapting the temperature of the airstream in the third station so that the coating layer of melted polymeric powder sprayed onto and retained on the surfaces of the objects in the second station reaches its melting temperature but not its flowing temperature.

21. Plant for powder coating the surfaces of objects with polymeric powder having a melting temperature less than about 100° C., said polymeric powder including a polymer curable under the influence of electromagnetic radiation, said plant comprising:

a first chamber in which said objects to be coated are prepared to retain said polymeric powder charged with static electricity;

a second chamber in which said objects are sprayed with said polymeric powder charged with static electricity in an atmosphere with the temperature in the range of about 10–40° C. and about 20–80 percent relative humidity;

a third chamber in which said objects are heated by exposure to infrared radiation to a surface temperature of no greater than about 100° C. thereby melting the powder retained on the objects and by heated air directed towards said objects, said heated air and said infrared radiation having a temperature adapted to maintain the surface of said objects at no greater than about 100° C.; and a fourth chamber in which the objects are radiated by electromagnetic radiation for initiating the curing of the heated polymeric powder and simultaneously cooled by flowing air having a temperature of about 5° C. to 40° C. for maintaining the objects at a temperature below the melting temperature of said powder thereby compensating for the heating of said objects from said electromagnetic radiation.

22. The plant as claimed in claim 21, further including an airlock before and after said third chamber to prevent heated air escaping from the third chamber and entering an adjacent chamber.

23. The plant as claimed in claim 21, wherein said first chamber includes means for controlling the relative humidity therein and means for heating said objects by infrared radiation.

24. The plant as claimed in claim 23, further including control means for controlling the operation of said first chamber whereby the temperature measured at the surface of said objects is about 40° to 85° C. while retaining moisture thereon.

25. The plant as claimed in claim 24, further including in said second chamber means for grounding said objects so that said polymeric powder will be retained at the surface of said objects having electrical conductive properties resulting from said moisture produced on the surface of said objects.

26. Plant for powder coating the surfaces of objects with polymeric powder having a melting temperature less than about 100° C., said polymeric powder including a polymer curable under the influence of electromagnetic radiation, said plant comprising:

a first chamber for preparing said objects to be coated for retaining said polymeric powder;

a second chamber for spraying said objects with said polymeric powder having an electrostatic charge in a first conditioned atmosphere;

a third chamber for melting said polymer powder retained on said objects by heating said polymer powder by exposure to infrared radiation and by simultaneously directing heated air towards said objects, said heated air and said infrared radiation having a temperature adapted to maintain the surface of said objects less than about 100° C.; and a fourth chamber for radiating said objects with electromagnetic radiation for initiating the curing of the heated polymeric powder and simultaneous cooling said objects by flowing conditioned air over said objects, whereby said objects are maintained at a temperature below the melting temperature of said polymer powder thereby compensating for the heating of said objects from said electromagnetic radiation.

27. The plant as claimed in claim 26, further including an airlock before and after said third chamber to prevent heated air escaping from the third chamber and entering an adjacent chamber.

28. The plant as claimed in claim 26, wherein said first chamber includes means for controlling the relative humidity therein and means for heating said objects by infrared radiation.

29. Plant for powder coating the surface of heat sensitive objects polymer curable under the influence of electromagnetic radiation, said plant comprising:

a first chamber for storing said objects in an atmosphere having a predetermined relative humidity whereby said objects absorb moisture from said atmosphere, and heating means for pre-heating said objects by infrared radiation until the temperature at the surface of said objects has reached about 40° C. to 85° C. while retaining moisture thereon;

a second chamber for spraying said objects in an atmosphere having an air temperature of about 10° C. to 40° C. with said polymeric powder having an electrostatic charge, and means for grounding said objects so that said polymeric powder will be retained at the surface of said objects by means of electrostatic forces, the grounded objects having electrical conducting properties resulting from the moisture produced on the surface of said objects in said first chamber;

a third chamber for heating said objects to a temperature at which said polymeric powder melts by simultaneously using infrared radiation and means for blowing air having a predetermined temperature to maintain the surface temperature of said objects at less than about 100° C.; and a fourth chamber for curing said polymeric powder by exposing the surface of said objects to electromagnetic radiation while simultaneously blowing air against the surface of said objects, whereby the temperature of the polymeric powder during said curing is maintained at a temperature not substantially exceeding the melting temperature of said polymeric powder.

* * * * *